US010053282B2

(12) United States Patent
Dunn et al.

(10) Patent No.: US 10,053,282 B2
(45) Date of Patent: Aug. 21, 2018

(54) CASSETTE FOR DISPENSING PLEATED TUBING

(71) Applicants: Steven Bryan Dunn, Beverly Hills, CA (US); Kevin Douglas Johnson, Tarzana, CA (US)

(72) Inventors: Steven Bryan Dunn, Beverly Hills, CA (US); Kevin Douglas Johnson, Tarzana, CA (US)

(73) Assignee: Munchkin, Inc., Van Nuys, CA (US)

( * ) Notice: Subject to any disclaimer, the term of this patent is extended or adjusted under 35 U.S.C. 154(b) by 0 days.

(21) Appl. No.: 14/939,588

(22) Filed: Nov. 12, 2015

(65) Prior Publication Data

US 2016/0060025 A1 Mar. 3, 2016

Related U.S. Application Data

(63) Continuation-in-part of application No. 14/736,192, filed on Jun. 10, 2015, and a continuation of application No. 13/688,139, filed on Nov. 28, 2012, now Pat. No. 9,085,404, and a continuation of application No. 29/435,445, filed on Oct. 24, 2012, now Pat. No. Des. 695,541.

(60) Provisional application No. 62/078,915, filed on Nov. 12, 2015.

(51) Int. Cl.
*B65F 1/06* (2006.01)
*B65F 1/00* (2006.01)

(52) U.S. Cl.
CPC ..... *B65F 1/0006* (2013.01); *B65F 1/062* (2013.01); *B65F 2210/1675* (2013.01); *B65F 2240/132* (2013.01)

(58) Field of Classification Search
CPC .. B65F 1/0006; B65F 1/062; B65F 2240/132; B65F 2210/1675
USPC ..... 206/409, 389, 303; 220/495.07
See application file for complete search history.

(56) References Cited

U.S. PATENT DOCUMENTS

| | | | |
|---|---|---|---|
| 2,989,828 | A | 6/1961 | Warp |
| 3,619,822 | A | 11/1971 | Carmichael |
| 3,723,999 | A | 4/1973 | Miller |
| 3,746,159 | A | 7/1973 | May |

(Continued)

FOREIGN PATENT DOCUMENTS

| | | |
|---|---|---|
| CA | 2486136 | 10/2010 |
| EP | 0303517 | 2/1989 |

(Continued)

OTHER PUBLICATIONS

International Search Report, dated Jan. 29, 2016, (pp. 1-3).
Written Opinion for PCT/US2015/060454, dated Jan. 29, 2016, (pp. 1-6).

*Primary Examiner* — Steven A. Reynolds
(74) *Attorney, Agent, or Firm* — Robert Z. Evora, Esq.; Christian Lek

(57) ABSTRACT

A cassette for use in dispensing a pleated tubing. The cassette includes an annular body having a generally U shaped housing with a central cylindrical core. The at least one wall has an upper end with a downturn lip disposed thereon. An annular cover extends radially outward from the central cylindrical core over the annular body defining a gap. The cover has a socket into which the upper end with the downturn lip is secured. A tubing is disposed within the u-shaped housing and withdrawn from the gap.

20 Claims, 12 Drawing Sheets

(56) References Cited

U.S. PATENT DOCUMENTS

| | | | | |
|---|---|---|---|---|
| 4,869,049 | A | 9/1989 | Richards et al. | |
| 5,971,194 | A | 10/1999 | Freedland | |
| 6,128,890 | A | 10/2000 | Firth | |
| 6,925,781 | B1 | 8/2005 | Knuth et al. | |
| 6,974,029 | B2 | 12/2005 | Morand et al. | |
| 8,484,936 | B2 | 7/2013 | Tannock | |
| 2003/0121923 | A1* | 7/2003 | Morand | A47K 11/02 220/495.07 |
| 2007/0219425 | A1 | 9/2007 | Moore | |
| 2008/0121640 | A1 | 5/2008 | Chomik et al. | |
| 2008/0272140 | A1* | 11/2008 | Mowers | B65F 1/062 221/69 |
| 2014/0110293 | A1 | 4/2014 | Dunn et al. | |

FOREIGN PATENT DOCUMENTS

| | | |
|---|---|---|
| EP | 1212248 | 8/2003 |
| WO | 9939995 | 8/1999 |
| WO | 02100723 | 12/2002 |

* cited by examiner

CASSETTE FOR DISPENSING PLEATED TUBING

CROSS REFERENCE TO RELATED APPLICATIONS

This application incorporates and claims the benefit of the filing date of U.S. Provisional Patent Application Ser. No. 62/078,915, entitled "CASSETTE FOR DISPENSING PLEATED TUBING" filed Nov. 12, 2014; and U.S. patent application Ser. No. 14/736,192, entitled "CASSETTE FOR DISPENSING PLEATED TUBING" filed Jun. 10, 2015; and U.S. patent application Ser. No. 13/688,139, entitled "CASSETTE FOR DISPENSING PLEATED TUBING" filed Nov. 28, 2012, now U.S. Pat. No. 9,085,404; and U.S. Design patent application Ser. No. 29/435,445, entitled "CASSETTE" filed Oct. 24, 2012, now U.S. Pat. D695,541, the entirety of which is incorporated herein by reference.

TECHNICAL FIELD

The subject disclosure relates to a cassette used for dispensing pleated tubing. More specifically, to a cassette capable of storing a pleated tubing and adapted for use within a disposal container to collect waste refuse.

BACKGROUND

Various refillable cassettes have been provided for the disposal of waste material. Conventional dispensers typically require cumbersome techniques overcome by the disclosure below. Despite the ineffectiveness of these conventional attempts to provide a storage cassette, a need exists for a low cost, efficient storage container that can be conveniently assembled.

BRIEF DESCRIPTION OF THE DRAWINGS

Various exemplary embodiments of this disclosure will be described in detail, wherein like reference numerals refer to identical or similar components or steps, with reference to the following figures, wherein.

DETAILED DESCRIPTION

Figure 1:
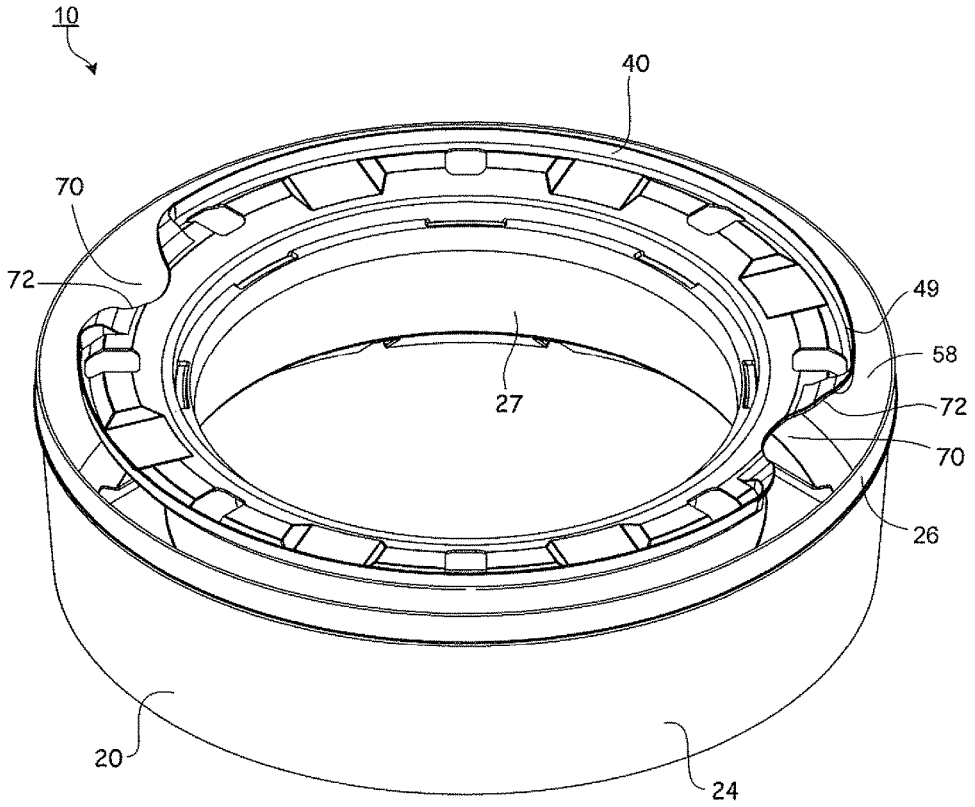
FIG. 1 illustrates an upper perspective view of an exemplary cassette according to the subject disclosure.

Particular embodiments of the present invention will now be described in greater detail with reference to the figures.

FIGS. 1-4 illustrate upper and lower perspective and exploded perspective views of an exemplary cassette 10 according to this subject disclosure.

FIGS. 1-4 show the cassette 10 is comprised of a lower annular body 20 having a generally U-shaped cross-section compartment and an annular cover 40 that extends over a portion of the U-shaped channel cross-section compartment. An opening 58 is provided between an outer concentric edge 49 of the annular cover 40 and an upper end 26 of an outer wall 24 of the lower annular body 20. The annular cover 40 is attached to the lower annular body 20 at a central cylindrical core 27, as will be discussed in greater detail below.

Figure 2:
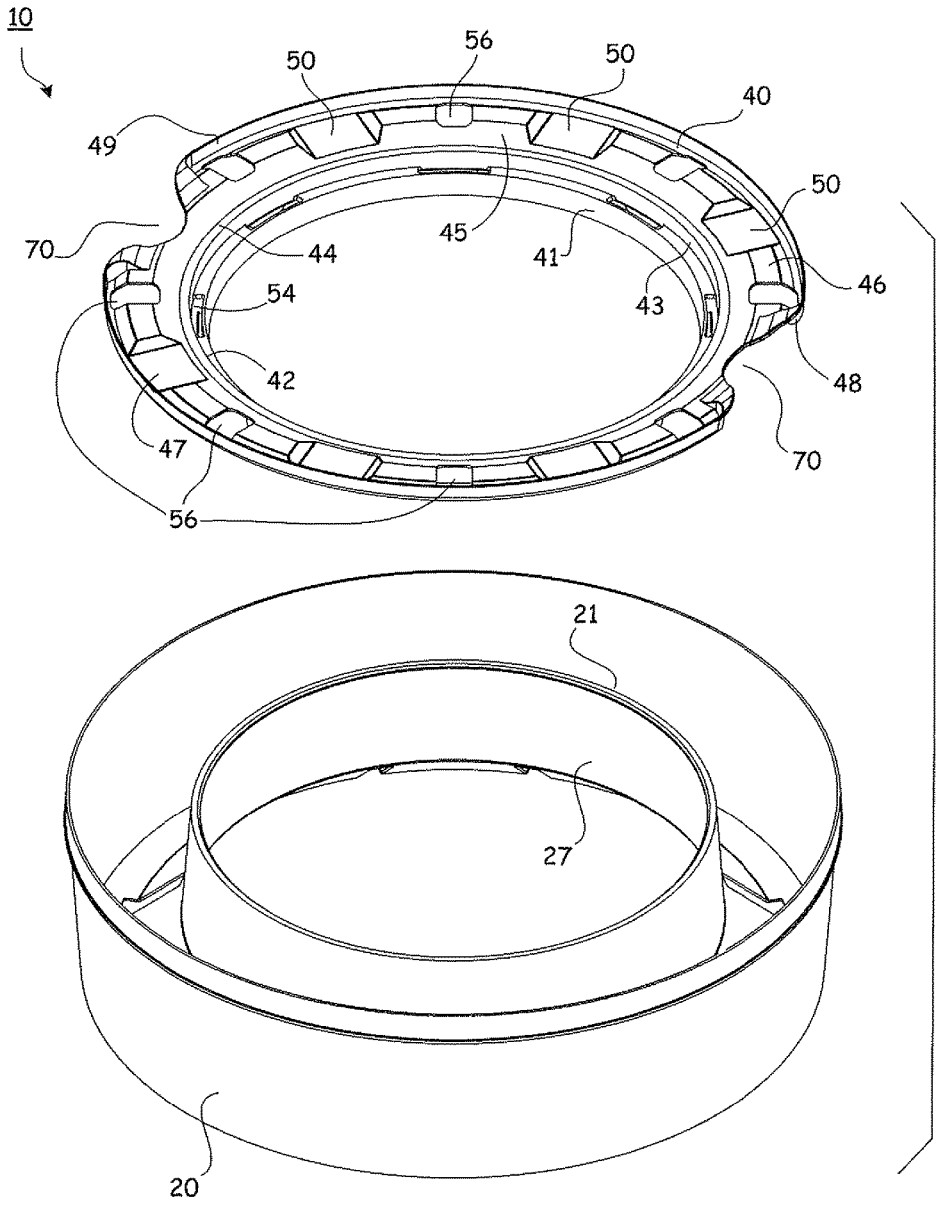
FIG. 2 depicts an exploded upper perspective view of an annular cover and annular body of the cassette according to the subject disclosure.
Figure 13:
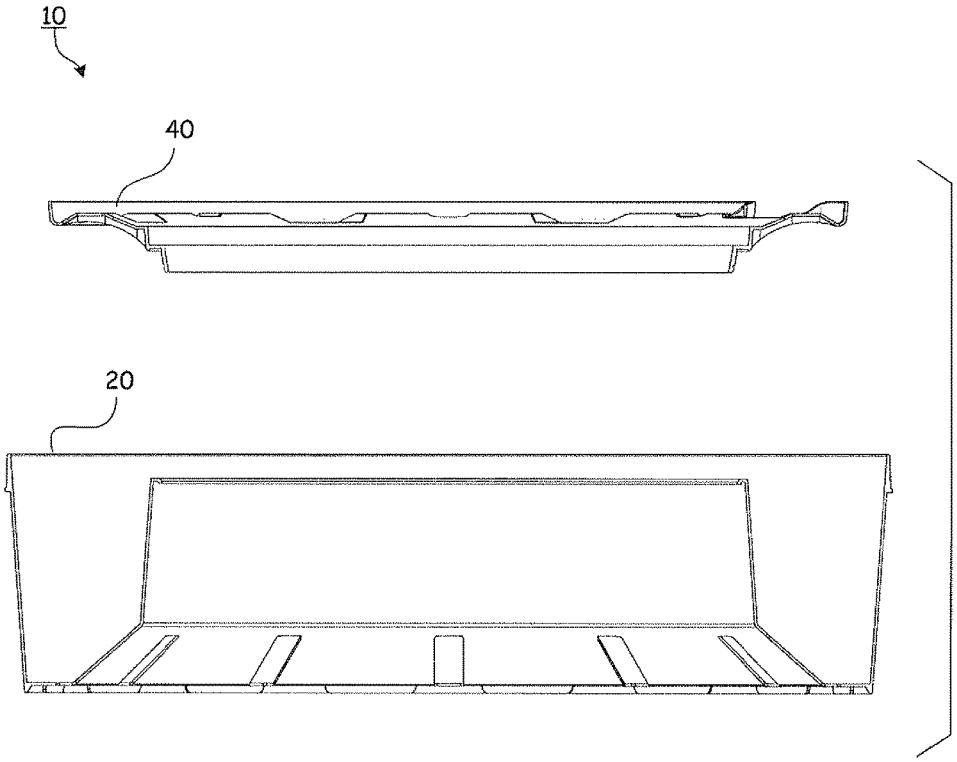
FIG. 13 shows an exploded cross section side view of the annular cover and annular body of the cassette.

FIGS. 2 and 13 illustrate an upper view of the cassette 10 having the annular cover 40. The annular cover 40 generally has an inner cylindrical wall 41 and upper horizontal wall 46. The annular cover 40 may have at least one recessed plateau 50 and at least one through hole 56 disposed in the upper horizontal wall 46. The annular cover 40 may also have at least one engagement groove 70.

Figure 11:
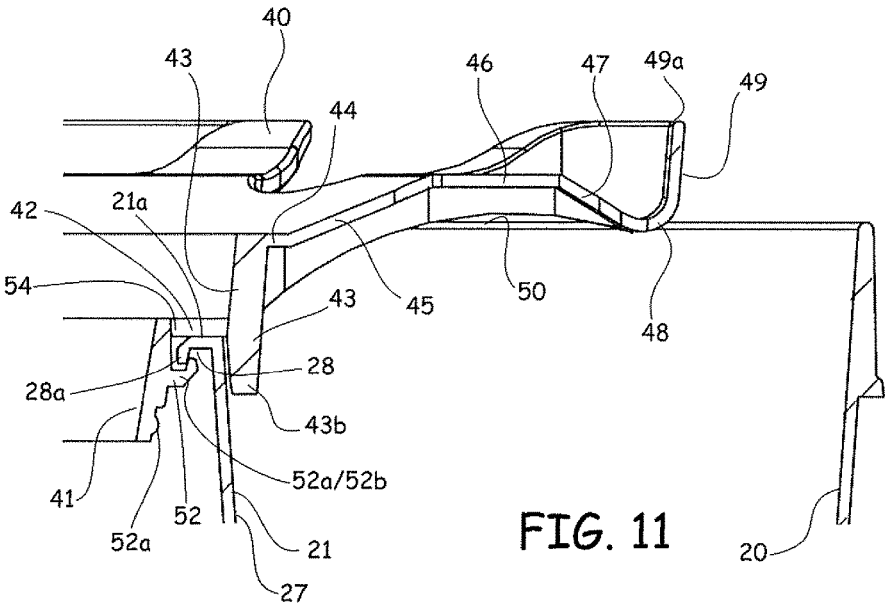
FIG. 11 illustrates a partial cross section side view of the annular cover and annular body of the cassette as shown in FIG. 9.
Figure 12:
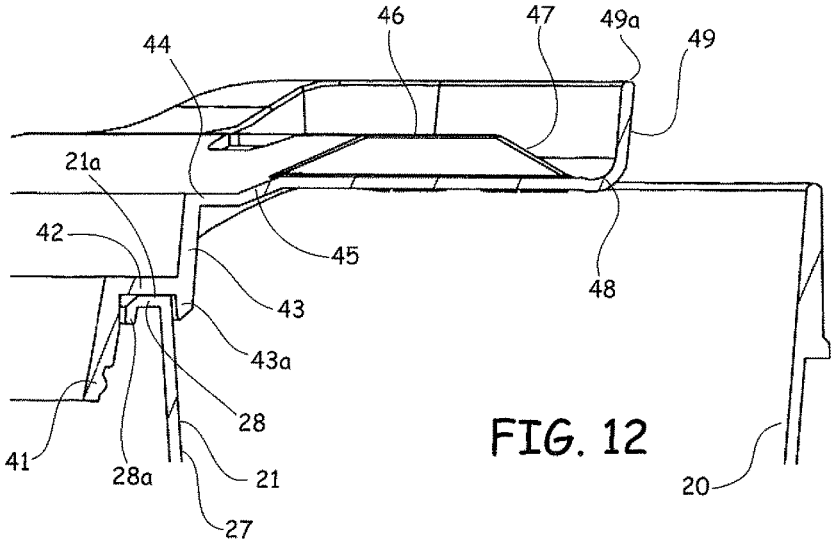
FIG. 12 depicts a partial cross section side view of the annular cover and annular body of the cassette as shown in FIG. 10.

FIG. 2 shows that the annular cover 40 may be constructed with a series of vertical, angled and horizontal walls from the inner cylindrical wall 41 to the outer concentric edge 49 (as shown in greater detail in the cross section views in FIGS. 11-12). The inner cylindrical wall 41 is connected to a first horizontal wall 42, which radially extends outward and terminates at a second cylindrical wall 43. The second cylindrical wall 43 is connected a second horizontal wall 44, which radially extends outward and terminates at an upward angular wall 45. The upward angular wall 45 is connected to the upper horizontal wall 46, which terminates at a downward angular wall 47. The downward angular wall 47 extends downward for a predetermined distance and then curves upward at a curved portion 48 and is connected to the outer concentric edge 49 that extends upward to an edge 49*a*.

The inner cylindrical wall 41, first horizontal wall 42, second cylindrical wall 43, second horizontal wall 44, upward angular wall 45, upper horizontal wall 46, downward angular wall 47, curved portion 48 and outer concentric edge 49 collectively may form the annular cover 40. It is to be understood, however, that the annular cover 40 may be constructed by any combination of the aforementioned segments to provide a cover of the U-shaped channel cross-section compartment.

Figure 3:
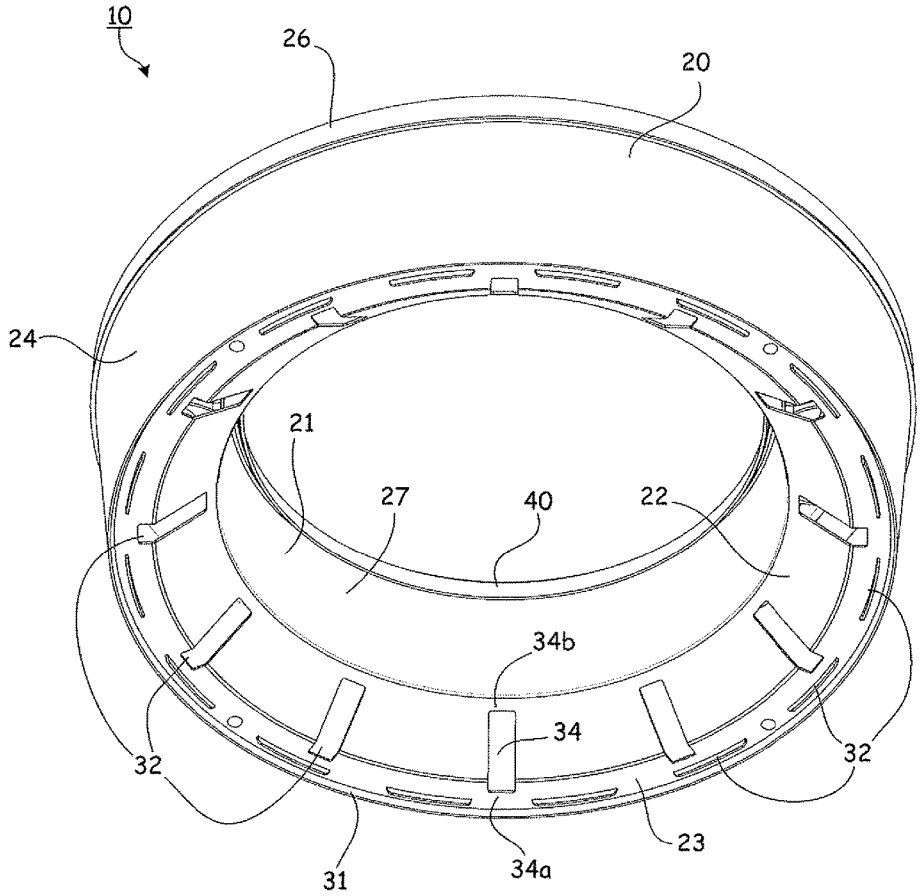
FIG. 3 illustrates a lower perspective view of the cassette.

FIG. 3 depicts a lower perspective view of the cassette 10. The lower annular body 20 includes an inner wall 21 connected to an angular wall 22. The angular wall 22 is connected to a bottom wall 23, which is connected to an outer wall 24. The outer wall 24 terminates at an upper end 26 thereof. The inner wall 21, angular wall 22, bottom wall 23 and outer wall 24 collectively form the U-shaped channel cross-section of a housing into which a pack 82 of a pleated flexible tubing 80 is received, as shown in FIG. 14.

Figure 14:
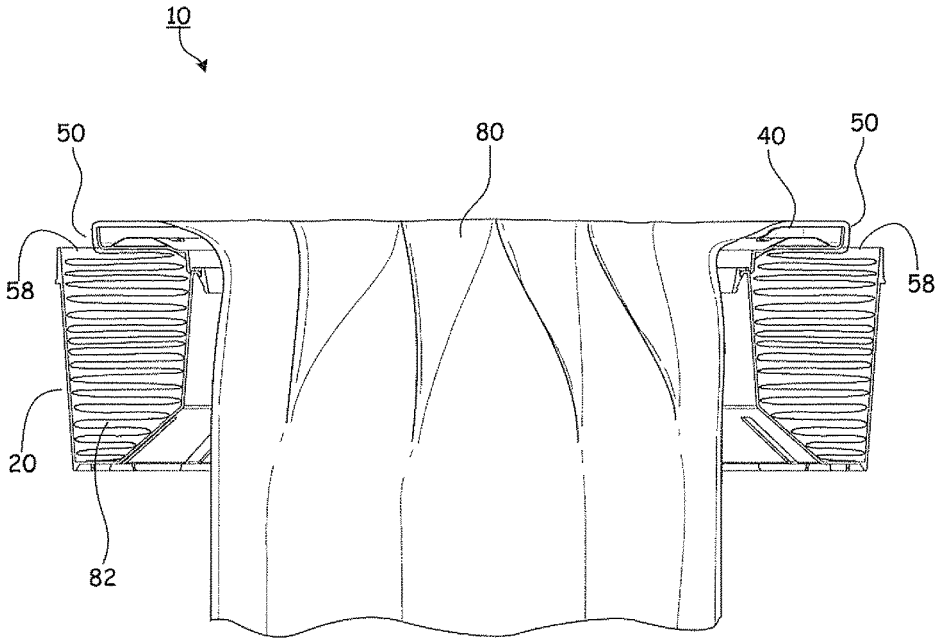
FIG. 14 illustrates a cross section view of the cassette having a flexible tubing disposed therein.

The lower configuration of the U-shaped channel cross-section and/or the angular configuration taken by the angular wall 22 may take a variety of different suitable angles in order to allow air to escape from below during the packing of the flexible tubing 80 into the lower annular body 20 as a packed tubing 82 as shown in FIG. 14 and described in more detail later. For example, the angular wall may be directly connected between the outer wall 24 and the inner wall 21, without the need for a bottom wall 23.

FIG. 3 illustrates the bottom wall 23 of the annular body 20 may also have a bottom lip 31, a plurality of concentric downward projections 32 and a plurality of apertures 34. The bottom lip 31 may be an extension of the outer wall 24 which extends past the bottom wall 23. The bottom lip 31 and downward projections 32 may provide an alignment feature for stacking multiple cassettes 10. A diameter of the bottom lip 31 may be sized such that when a first cassette 10 is stacked on the top of a second cassette 10, either the inside or outside face of the bottom lip 31 will nest the upper end 26 of the annular body 20. Furthermore, the concentric downward projections 32 may also provide a nesting function such that, the upper end 26 of the second cassette 10 is nested in between the bottom lip 31 and the concentric downward projections 32 or is nested inside the downward projections 32.

FIGS. 3-6 illustrate the plurality of apertures 34 that may be disposed in a radial configuration in the lower end of the annular body 20. As shown, the apertures 34 may be elongated, radially extending inwardly lengthwise from a first end 34*a* disposed in the bottom wall 23, to a second end 34*b* inwardly extending adjacent to the intersection of the angular wall 22 and the inner wall 21. The apertures 34 may be cut into the angular wall 22 and the bottom wall 23 and disposed concentrically about in a radial pattern.

The apertures 34 provide various advantages. First, during installation of the air-tight packing of the flexible packed tubing 82 into the U-shaped lower annular body 20, the various apertures 34 serve as vent holes allowing air trapped below the packed tubing 82 to vent out of the lower annular body 20 through the apertures 34. The venting provided by the various apertures 34 allow the packed tubing 82 to be compressed tightly as a pleated mass within the U-shaped lower annular body 20 without air interfering with the volume within the lower annular body 20 that could otherwise be filled by the packed tubing 82. As a result, no air is trapped below the packed tubing 82 thereby allowing a tighter pack to be obtained so that more of the flexible tubing 80 in the compressed packed tubing 82 state can be stored within the lower annular body 20 during assembly of the tubing 80 into the cassette 10. It is understood that the aperture 34 may be constructed into any one, or more, of the various walls 21, 22, 23, 24, or the like.

Another significant advantage to the apertures 34 is the ability to control the rotation of the cassette 10. The apertures 34 may function as key holes into which a mating key of a rotation mechanism can be used to control the rotation of the cassette 10 during operation of a unit (such as a waste receptacle) into which the cassette 10 may be placed and used. That is, a key may be aligned to mate with at least one of the apertures 34. The key may engage any portion of the aperture 34 on any wall 21, 22, 23, 24 surface and cause the cassette 10 to rotate, or prevent the cassette 10 from rotating by arresting the movement of the cassette 10.

Although the apertures 34 are shown as equidistant symmetric elongated rectangular slots extending across the angular wall 22 and the inner wall 21, it is possible to vary the number of apertures 34, their placement, the size and/or shape of the various apertures 34 to any number, size, symmetry or shape according to this subject disclosure. Likewise, is it also possible to extend the aperture 34 into the outer wall 24, or alternatively provide the apertures 34 on any one, or more, of the inner wall 21, the angular wall 22, the bottom wall 23 or the outer wall 24.

Figure 4:
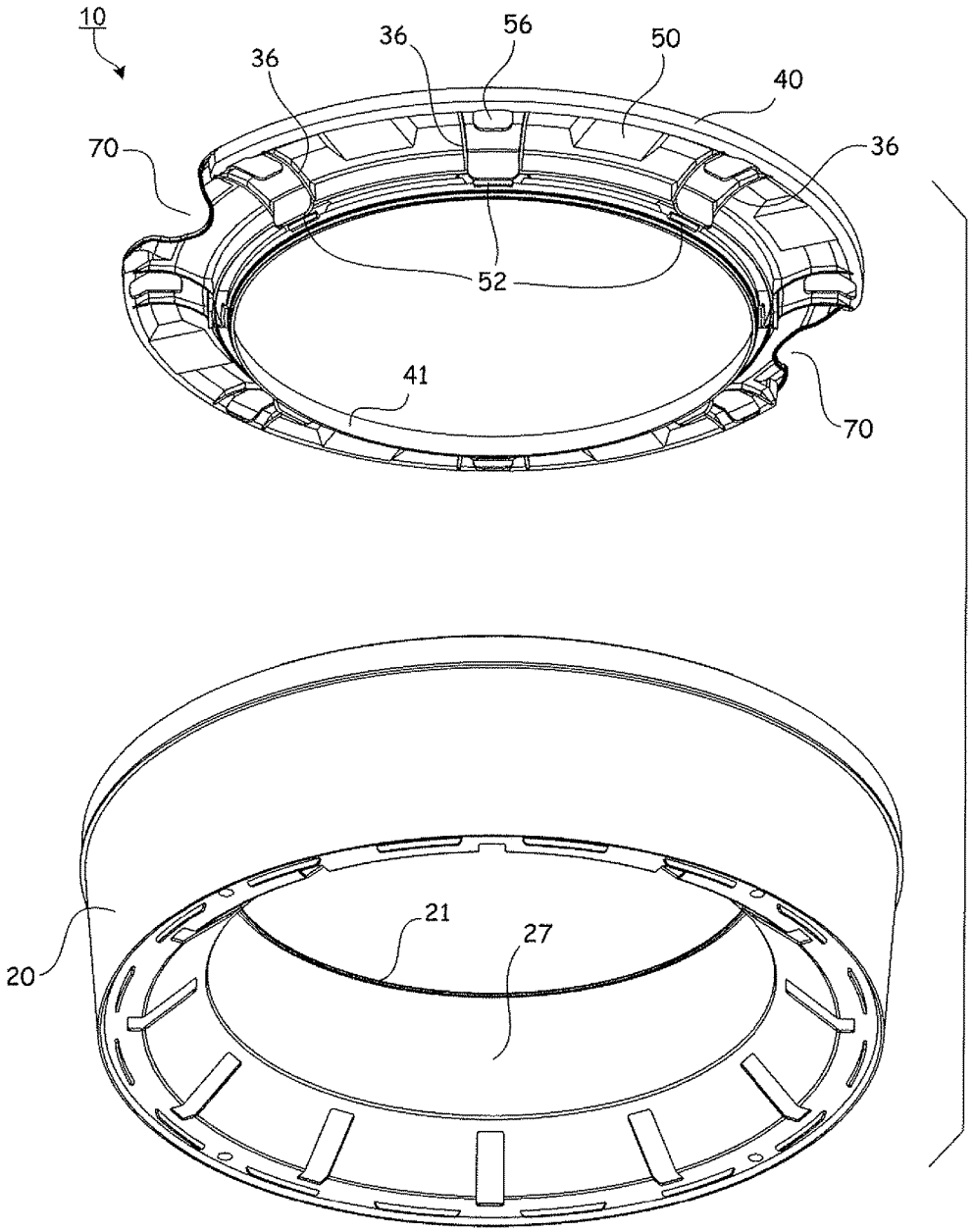
FIG. 4 depicts an exploded lower perspective view of the annular cover and annular body of the cassette.
Figure 4A:
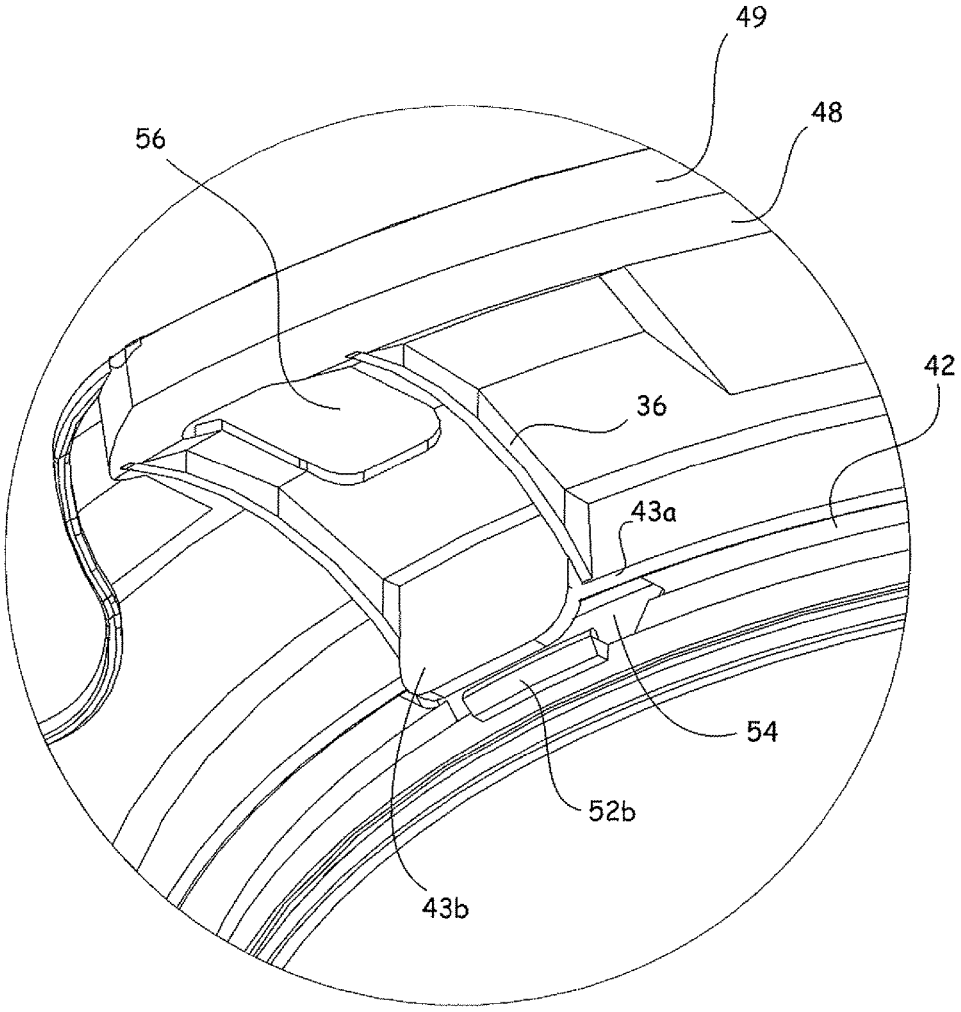
FIG. 4A depicts a partial exploded lower perspective view of a section of the annular cover as shown in FIG. 4.
Figure 5:
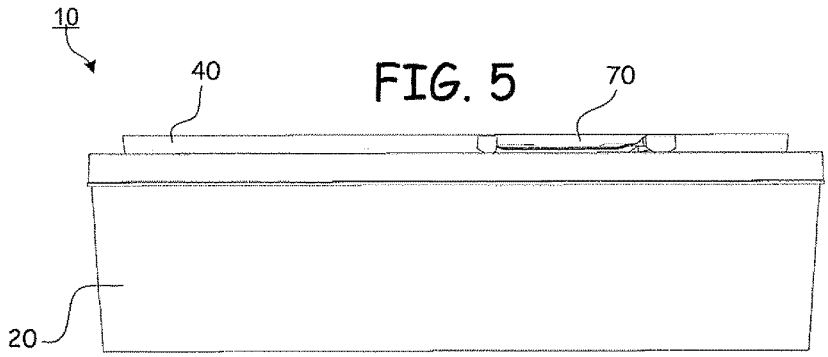
FIG. 5 shows a side view of the cassette.
Figure 6:
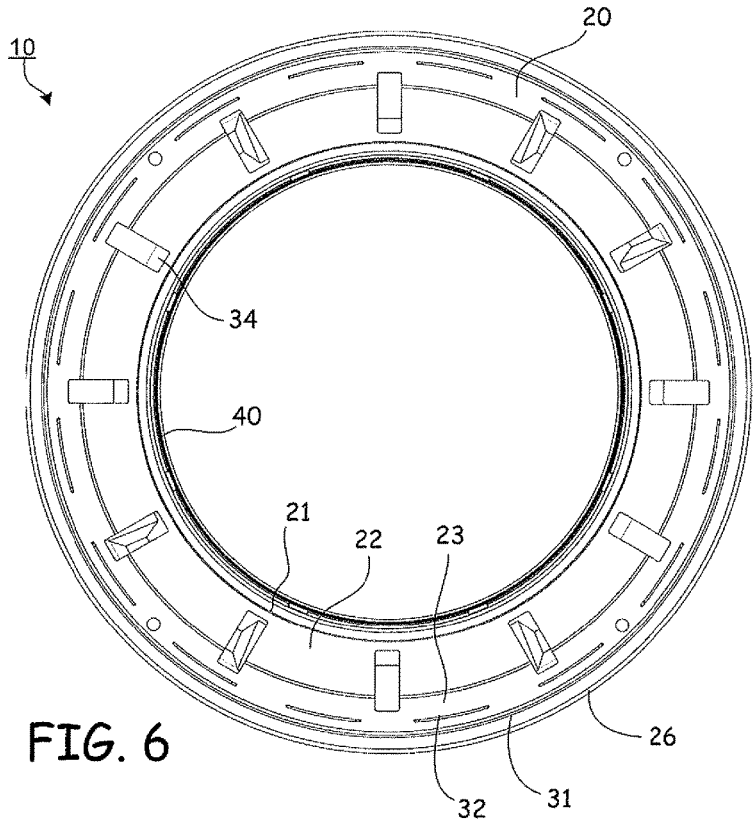
FIG. 6 illustrates a bottom view of the cassette.
Figure 7:
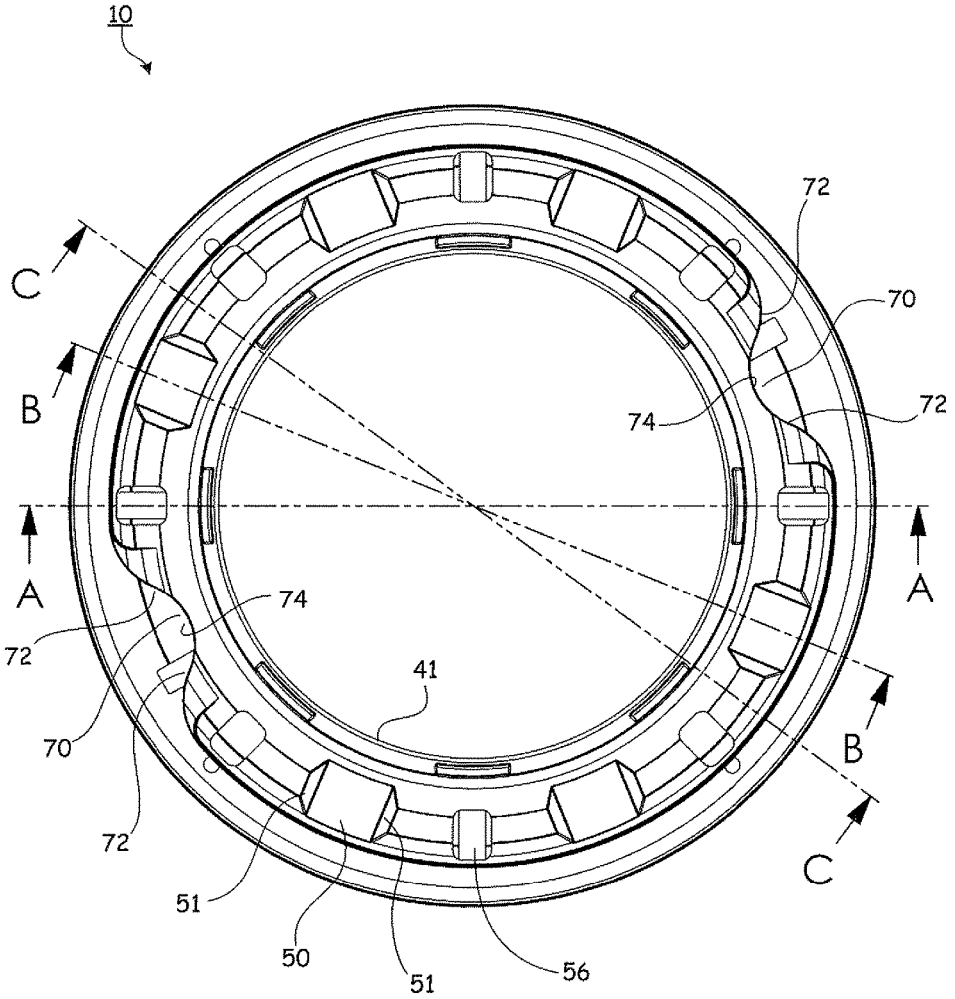
FIG. 7 depicts a top view of the cassette.
Figure 8:
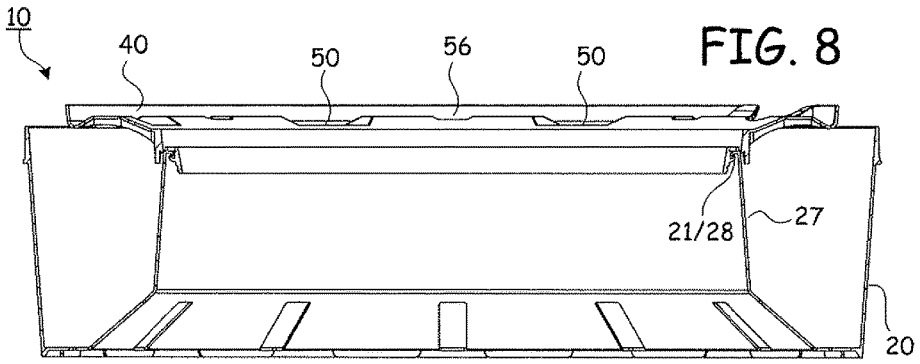
FIG. 8 illustrates a cross section side view of the annular cover and annular body of the cassette at through holes of the annular cover about line A-A in FIG. 7.
Figure 9:
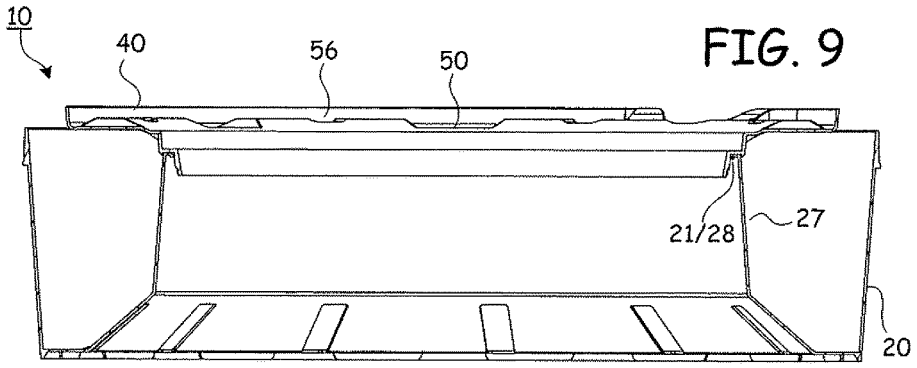
FIG. 9 depicts a cross section side view of the annular cover and annular body of the cassette at an access hole and recessed plateau of the annular cover about line B-B in FIG. 7
Figure 10:
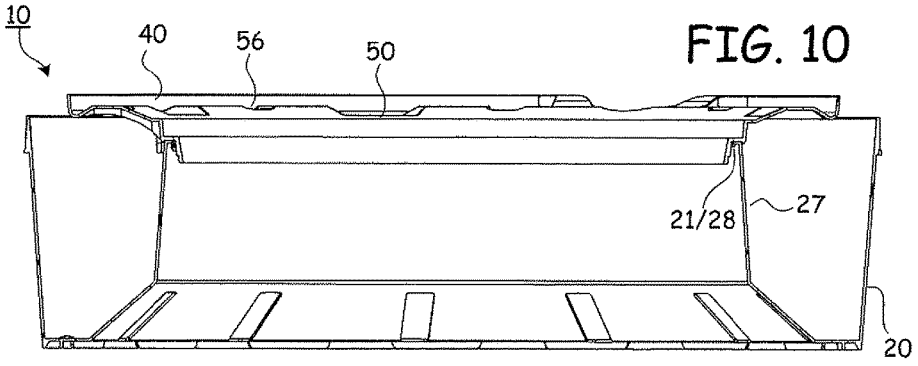
FIG. 10 shows a cross section side view of the annular cover and annular body of the cassette at an upper horizontal wall about line C-C in FIG. 7.

FIGS. 4 and 4A depict an exploded and enlarged lower perspective view of the annular cover 40 and annular body 20 of the cassette 10. An inner surface of the inner cylindrical wall 41 may have a projection 52 which engages the annular body 20 to attach the annular cover 40 to the annular body 20, as will be discussed in greater detail below.

The annular cover 40 may also have a series of reinforcing bridges 36 along an underside thereof. An axis of each reinforcing bridge 36 may extend outward radially from a center of the annular cover 40. The reinforcing bridges may span from the inner cylindrical wall 41 to the outer concentric edge 49, or any portion thereof. The reinforcing bridges 36 structurally support the annular cover 40 to retain its shape as the flexible tubing 80 is pulled through the opening 58 over and through the center of the cassette 10.

FIGS. 7-13 depict various top views of the lower annular body 20 and the annular cover 40. The annular cover 40 is disc shape and has a central through hole defined by an inner cylindrical wall 41. The inner cylindrical wall 41 extends upward to a first horizontal wall 42. The first horizontal wall 42 extends from a first end inward to a second cylindrical wall 43. The second cylindrical wall 43 extends upward to a second horizontal wall 44 that is elevated above the first horizontal wall 42. At the lower end of second cylindrical wall 43 a concentric shoulder 43*a* is formed that extends slightly below the lower surface of the first horizontal wall 42. The second horizontal wall 44 extends radially outward to an upper angular wall 45. The upper angular wall 45 extends radially upward and outward at an angle to an upper horizontal wall 46. The upper horizontal wall 46 extends radially outward to a downward angular wall 47. The downward angular wall 47 extends radially downward from a first end to a curved portion 48. The curved portion 48 has a slight u-shape that returns the shape of the annular cover back upward into an outer concentric edge or wall 49.

The annular cover 40 is attached to the lower annular body 20 at an annular downturned lip 28 provided at a top edge 21*a* of the inner concentric wall 21 defining the central cylindrical core 27. The downward turned lip 28 constructed at the top edge 21*a* of the central cylindrical core 27 is nestled within a cup shaped structure defined by the inner cylindrical wall 41, the first horizontal wall 42 and the concentric shoulder 43*a* disposed at the bottom of the second cylindrical wall 43. As shown in FIGS. 11-12, the concentric shoulder 43*a*, 43*b* extends radially around and captivates the top edge 21*a* of the inner concentric wall 21 to secure the annular cover 40 to the lower annular body 20.

The shorter concentric shoulder 43*a* may be constructed with intermittent extending flanges 43*b* or return walls, such as shown in exploded view in FIG. 4A. The advantage of providing the intermittent extending flanges 43*b* is to be able to more securely captivate and secure the top edge 21*a* of the inner concentric wall 21 within the cup shaped structure defined by the inner cylindrical wall 41, the first horizontal wall 42 and the concentric shoulder 43*a* disposed at the bottom of the second cylindrical wall 43. The intermittent extending flanges 43*b* may extend to, or at least beyond the width of the annular downturned lip 28 disposed at the top edge 21*a* of the inner wall 21. The intermittent extending flange 43*b* may extend to at least the height of the protrusion 52*b* disposed on the inside of the inner cylindrical wall 41.

The grooves 70 are adapted to receive an indexing mechanism to manipulate the orientation of the cassette 10. For example, a user can manually use the grooves to engage with their fingers to manually twist the annular cover 40 into a desired position. The advantage to providing this feature is to manually rotate the cassette 10 via the top of the lower annular body 20.

Figure 1A:
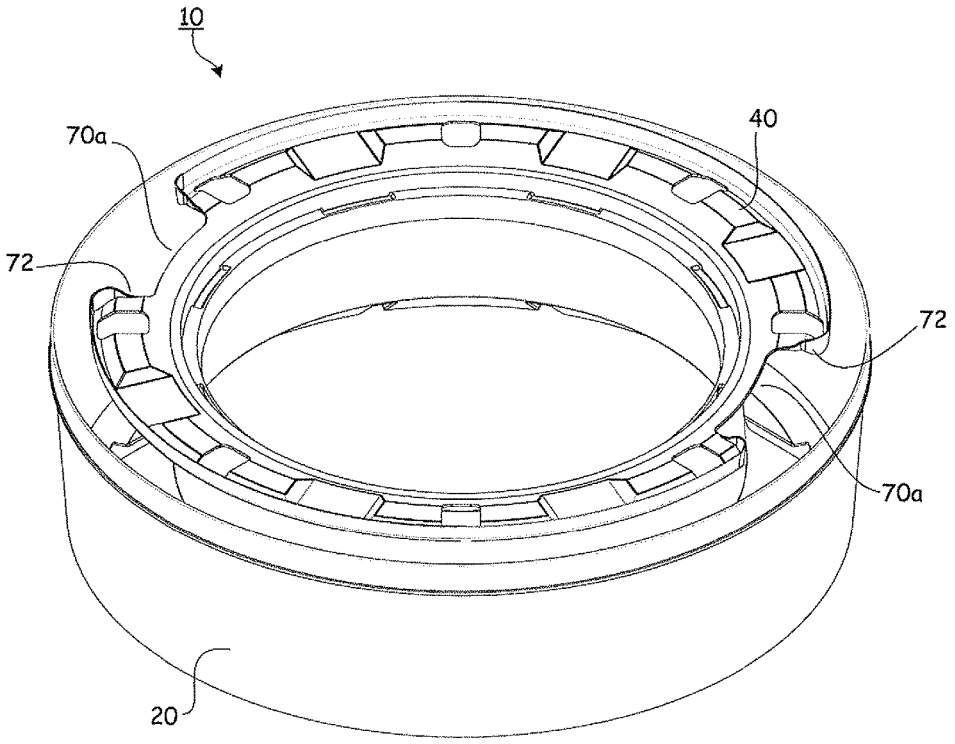
FIG. 1A shows an alternative upper perspective view of a cassette with a different engagement groove configuration.

By way of example shown in FIG. 1A, the construction of the grooves 70, 70*a* may take a variety of different sizes, shapes and/or configurations according to this subject disclosure. The outer edge surface of the grooves 72 may be constructed of a material and/or shape having a low coefficient of friction so that the tubing pulled over those surfaces is not torn, frayed or fatigued by a sharp corner of edge. Likewise, the annular cover 40 may be constructed without the grooves 70, 70*a*.

A plurality of apertures or through holes 56 may be provided on the top of the annular cover 40 for orientation purposes. Furthermore, the through holes 56 may be provided to allow aeration of a deodorant integrated with the material composition of the tubing material. The aeration through holes 56 can counteract any foul odor in the vicinity of the cassette 10, particular when the cassette 10 used in a waste disposal container or unit.

A plurality of adjacent elevated bosses and recessed plateaus may also be constructed around the upper surface of the annular cover 40. The elevated bosses and recessed plateaus are constructed by a plurality of recessed plateaus being straddled by elevated ledges 51 that support various upper horizontal walls 46 forming a step-like configuration about the top end of the annular cover 40. This construction has further advantages in permitting the cassette 10 to be rotated about the upper surface end of the annular cover 40.

As shown in FIGS. 11-12, in place, the annular cover 40 and the lower annular body 20 are lockingly engaged to one another as described above. To prevent the annular cover 40 from being disconnected from within the expanded inner wall 21 of the lower annular body 20, the annular cover 40 is lowered and positioned within an annular downturned lip 28 of the inner wall 21 of the annular body 20 so that a peripheral edge 28*a* of the lip 28 slides past a ramp 52*a* of the protrusion 52. As the peripheral edge 28*a* slides along the ramp 52*a*, the inner wall 21 will deflect outward away from the center of the annular body 20 and against the retaining flanges 43*a*. 43*b*. When the peripheral edge 28*a* completely slides along the ramp 52*a*, it will snap inward and rest above a locking shelf 52*b* and against the retaining flanges 43*a*, 43*b* as shown in FIGS. 11-12.

The peripheral edge 28*a* of the annular downturned lip 28 is then locked against the locking shelf 52*a* of the projection 52. The projection 52 functions as a detent and the retaining flanges 43*a*, 43*b* act as a captivating stop so that the annular cover 40 is mechanically arrested and cannot be undesirably lifted or raised off of the lower annular body 20 after the peripheral edge 28*a* has been securely mounted against the locking shelf 52*a* and the retaining flanges 43*a*. 43*b*. In use, the flexible tubing 82 disposed within the cassette 10 is withdrawn with sufficient force upward from within the u-shaped lower annular body 20 and then over and downward over the annular cover 40 and into the cylindrical core 27 to cause the cassette to be jostled within the container it is situated. Unlike conventional designs before, the socket connection of this subject disclosure between the u-shaped lower annular body 20 and the annular cover 40 is sufficiently secure to prevent the shape of the cassette to be warped and the annular cover 40 disengaged from the lower annular body 20.

Access holes 54 are disposed in the first horizontal wall 42. The access holes 54 are provided to allow visual alignment of the top edge 21 of the annular downturned lip 28 into the socket area constructed by the concentric should 43*a*, 43*b*, the first horizontal wall 42, the inner horizontal wall 41 and the locking flange 52.

FIG. 14 depicts the tubing 80 shown as a packed tubing 82 disposed in the U-shaped channel cross-section of the lower annular body 20. The packed tubing 82 is adapted to be received and pulled upward from within the U-shaped channel, through the opening 58, up and over the outer concentric edge 49, across the annular cover 40, and downward through the central cylindrical core 27 opening. The tubing 80 may be made from a variety of different materials. The tubing 80 may be made of various compositions and may also be scented.

This application incorporates by reference all of the subject matter in U.S. Provisional Patent Application Ser. No. 62/078,915, entitled "CASSETTE FOR DISPENSING PLEATED TUBING" filed Nov. 12, 2014; U.S. patent application Ser. No. 13/688,139, entitled "CASSETTE FOR DISPENSING PLEATED TUBING" filed Nov. 28, 2012; and U.S. Design patent application Ser. No. 29/435,445, entitled "CASSETTE" filed Oct. 24, 2012, the entirety of which is incorporated herein by reference.

The illustrations and examples provided herein are for explanatory purposes and are not intended to limit the scope of the appended claims. It will be recognized by those skilled in the art that changes or modifications may be made to the above described embodiment without departing from the broad inventive concepts of the invention. It is understood therefore that the invention is not limited to the particular embodiment which is described, but is intended to cover all modifications and changes within the scope and spirit of the invention.

What is claimed:

1. A cassette to dispense a pleated tubing, comprising:

an annular body having a generally U shaped housing with a central cylindrical core, at least one wall has an upper end with a downturn lip disposed thereon;

an annular cover extending radially outward from the central cylindrical core over the annular body defining a gap, the cover having a socket into which the upper end with the downturn lip is secured; and a tubing disposed within the u-shaped housing and withdrawn from the gap, wherein the socket comprises:

a shoulder that extends around a portion of a first side of the upper end of the at least one wall of the annular body;

a horizontal wall that extends from the shoulder over a top surface of the at least one wall of the annular body; and a cylindrical wall that extends around a second side of the upper end of the at least one wall of the annular body.

2. The cassette recited in claim 1, wherein the cylindrical wall extends over a remote end of the upper end of a return angle; and the socket further comprises a locking flange extending from the cylindrical wall that extends over the remote end of the upper end of the return angle, the locking flange adapted to mate with the downturn lip.

3. The cassette recited in claim 1, wherein the annular cover has at least one recess adapted to rotate the cassette.

4. The cassette recited in claim 1, wherein the annular cover has at least one cover aperture adapted to rotate the cassette.

5. The cassette recited in claim 1, wherein the annular body has at least one body aperture adapted to rotate the cassette.

6. The cassette recited in claim 5, wherein the at least one body aperture is provided in an angular wall in the annular body.

7. The cassette recited in claim 2, wherein the shoulder is concentric and abuts the first side of the upper end of the at least one wall of the annular body completely around the annular body.

8. The cassette recited in claim 2, wherein the shoulder is intermittently concentric about the upper end of the at least one wall of the annular body there around.

9. The cassette recited in claim 2, wherein the shoulder extends substantially further than a length of a peripheral edge of the annular downturned lip.

10. The cassette recited in claim 2, wherein the shoulder extends to substantially a length of the locking flange.

11. The cassette recited in claim 2, wherein the locking flange extends to substantially a length as long as the downturned lip.

12. The cassette recited in claim 2, wherein the locking flange extends to substantially a length longer than the downturned lip.

13. A cassette to dispense a pleated tubing, comprising:

an annular body having a generally U shaped housing with a central cylindrical core, at least one wall has an upper end with a downturn lip disposed thereon; and an annular cover extending radially outward from the central cylindrical core over the annular body defining a gap, the cover having a socket into which the downturn lip is secured, the socket comprises:

a shoulder that extends around a portion of a first side of the upper end of the at least one wall of the annular body;

a horizontal wall that extends from the shoulder over a top surface of the at least one wall of the annular body;

a cylindrical wall that extends over a remote end of the upper end of a return angle and around a second side of the upper end of the at least one wall of the annular body; and a locking flange extending from the cylindrical wall that extends over the remote end of the upper end of the return angle.

14. The cassette recited in claim 13, wherein the annular cover has at least one recess or cover aperture adapted to rotate the cassette.

15. The cassette recited in claim 13, wherein the annular body has at least one body aperture adapted to rotate the cassette.

16. The cassette recited in claim 15, wherein the at least one body aperture is provided in an angular wall in the annular body.

17. The cassette recited in claim 13, wherein the shoulder is concentric and abuts the first side of the upper end of the at least one wall of the annular body completely around the annular body.

18. The cassette recited in claim 13, wherein the shoulder is intermittently concentric about the upper end of the at least one wall of the annular body there around.

19. The cassette recited in claim 13, wherein the shoulder extends substantially further than a length of a peripheral edge of the annular downturned lip.

20. A cassette to dispense a pleated tubing, comprising:

an annular body having a generally U shaped housing with a central cylindrical core, at least one wall has an upper end with a downturn lip disposed thereon;

an annular cover extending radially outward from the central cylindrical core over the annular body defining a gap, the cover having a socket shape construction into which the downturn lip is secured and the upper end is secured, the socket shape construction comprises:

a shoulder that extends around a portion of a first side of an upper end of the one wall of the annular body;

a horizontal wall that extends from the shoulder over a second side of the at least one wall of the annular body;

a cylindrical wall that extends over a remote end of the upper end of the downturn lip and around a third side of the at least one wall of the annular body; and a locking flange extending from the cylindrical wall that extends over the remote end of the upper end of the downturn lip; and a tubing disposed within the u-shaped housing and withdrawn from the gap.

* * * * *